US010138891B2

(12) United States Patent
Pemberton

(10) Patent No.: US 10,138,891 B2
(45) Date of Patent: Nov. 27, 2018

(54) DOUBLE SUCTION PUMP WITH AGITATORS

(71) Applicant: Steve V. Pemberton, Gautier, MS (US)

(72) Inventor: Steve V. Pemberton, Gautier, MS (US)

(73) Assignee: Pemberton Patents LLC, Gautier, MS (US)

( * ) Notice: Subject to any disclaimer, the term of this patent is extended or adjusted under 35 U.S.C. 154(b) by 223 days.

(21) Appl. No.: 15/006,738

(22) Filed: Jan. 26, 2016

(65) Prior Publication Data

US 2016/0245290 A1 Aug. 25, 2016

Related U.S. Application Data

(60) Provisional application No. 62/125,586, filed on Jan. 26, 2015.

(51) Int. Cl.

| | |
|---|---|
| ***F04D 7/04*** | (2006.01) |
| ***F04D 13/04*** | (2006.01) |
| ***F04D 29/043*** | (2006.01) |
| ***F04D 1/00*** | (2006.01) |
| ***F04D 29/22*** | (2006.01) |
| ***F04D 29/70*** | (2006.01) |

(52) U.S. Cl.

CPC ..... *F04D 7/045* (2013.01); *F04D 1/006* (2013.01); *F04D 7/04* (2013.01); *F04D 13/04* (2013.01); *F04D 29/043* (2013.01); *F04D 29/2222* (2013.01); *F04D 29/708* (2013.01)

(58) Field of Classification Search

CPC .... F04D 1/006; F04D 29/2222; F04D 29/221; F04D 29/426; F04D 7/04; F04D 7/045; F04D 9/02; F04D 13/04; F04D 13/086

USPC ..... 241/46.08, 46.11, 46.17, 185.6

See application file for complete search history.

(56) References Cited

U.S. PATENT DOCUMENTS

| | | | |
|---|---|---|---|
| 367,564 | A | 8/1887 | Wade et al. |
| 632,572 | A | 9/1899 | Ivens |
| 885,867 | A | 4/1908 | Salzer |
| 1,213,461 | A | 1/1917 | Cooper |
| 1,586,978 | A | 2/1921 | Dorer |
| 1,893,445 | A | 1/1933 | Rimele |
| 2,393,127 | A | 10/1943 | Summers |
| 3,160,107 | A | 10/1962 | Ross |
| 3,176,621 | A | 11/1963 | Phillips |

(Continued)

*Primary Examiner* — Kenneth J Hansen

(74) *Attorney, Agent, or Firm* — Jason P. Mueller; Adams and Reese LLP

(57) ABSTRACT

A double suction centrifugal pump is provided. An impeller is mounted inside a pump housing, which is mounted inside a three-dimensional frame made of two end plates connected by crossbars. The pump housing has opposing inlet openings on opposite sides of the housing so that fluid is sucked into the housing from both sides and discharged by the impeller. The impeller is mounted on a driveshaft that extends through the dual inlet openings and openings in each of the end plates. Dual hydraulic motors are mounted on the exterior of each respective end plate and cooperatively rotate the driveshaft. Agitators are attached to the driveshaft and rotate with the driveshaft. The agitators macerate solids such as vegetation or other organic matter so that the solid matter does not clog the pump intakes. The pump is effective for dredging and pumping sand and other abrasive solids and in severe service applications of high viscosity, high density fluids.

24 Claims, 4 Drawing Sheets

(56) References Cited

U.S. PATENT DOCUMENTS

| | | | | |
|---|---|---|---|---|
| 3,246,605 | A | 3/1964 | Fisher | |
| 3,817,653 | A | 6/1974 | Onal | |
| 3,910,715 | A | 10/1975 | Yedidiah | |
| 3,935,833 | A | 2/1976 | Onal | |
| 4,247,250 | A | 1/1981 | Lipe et al. | |
| 4,344,580 | A * | 8/1982 | Hoshall | B65G 65/46 198/664 |
| 4,518,311 | A | 5/1985 | Demedde et al. | |
| 4,688,987 | A | 8/1987 | Ericson et al. | |
| 4,786,239 | A | 11/1988 | Eberhardt | |
| 5,122,032 | A | 6/1992 | Shields et al. | |
| 5,980,199 | A | 11/1999 | Godichon | |
| 6,942,448 | B1 | 9/2005 | Pemberton | |
| 7,442,033 | B2 | 10/2008 | Wang | |
| 8,152,443 | B1 * | 4/2012 | Pemberton | F04D 1/006 415/102 |
| 2003/0059293 | A1 * | 3/2003 | Chancey | F04D 29/628 415/56.1 |
| 2003/0143082 | A1 * | 7/2003 | Thiriez | F04D 1/00 417/61 |
| 2007/0110595 | A1 * | 5/2007 | Sato | F04D 1/006 417/351 |
| 2008/0089777 | A1 | 4/2008 | Lang | |

* cited by examiner

DOUBLE SUCTION PUMP WITH AGITATORS

CROSS REFERENCES

This application claims the benefit of U.S. Provisional Application No. 62/125,586, filed on Jan. 26, 2015, which application is incorporated herein by reference.

FIELD OF THE INVENTION

A preferred embodiment of the invention refers to a pump apparatus and, more specifically, to a pump apparatus suitable for pumping a high density, high viscosity, or flowable viscous fluid from the bottom of a tank or water body.

BACKGROUND

Process tanks and waste pits are utilized in a variety of industrial settings to store many different types of liquids. Some liquids may contain a certain amount of solids, heavy oils, or similar heavy materials, which may result in the heavier materials accumulating in the bottom of the tank or pit over a period of time. When the tank is eventually required to be pumped dry for cleaning, inspection, change of service, or other reasons, the material to be pumped out from the bottom of the tank or pit may comprise a highly viscous fluid, heavy sludge, or sand or other abrasive solids. Similarly, aeration ponds or other similar types of water bodies may accumulate a layer of highly viscous fluid or sludge on the bottom of the pond. The sludge may form due to various types of solid waste, vegetation or other types of organic matter found in a water stream. Such heavy or highly viscous fluids that may contain some solid material can be difficult to remove from the bottom of the tank or pond because such fluids may damage or clog many conventional types of pumps. Sand solids are especially difficult to pump as they fall out of suspension almost instantly and do not readily remain suspended in a slurry that can be pumped.

Accordingly, a need exists in the art for a pump apparatus that can be used to pump high density, high viscosity fluids or semi-solid material such as sludge from the bottom of a tank or pond. Further, a need exists in the art for an easily portable pump apparatus that can be used to pump highly viscous fluids or abrasive solids from the bottom of a tank or pond. In addition, a need exists in the art for a pump apparatus that can be used to pump highly viscous fluids from a tank or pond in a safe, fast, and cost effective manner.

SUMMARY

In accordance with the present invention, there is provided a centrifugal pump apparatus that is capable of pumping highly viscous fluids or semi-solid material such as mud sludge and abrasive sand or other solids materials. The pump is particularly effective in pumping flowable material containing various types of solid waste such as vegetation or other organic matter. The pump apparatus is portable and submersible. The apparatus can be lowered to the bottom of a tank or pond and pump heavier materials containing solids off the bottom. Thus, the pump design of the apparatus is uniquely ideal as a portable dredge pump. The pump has a double suction configuration with dual annular inlet openings and agitators configured to agitate and macerate solid waste materials so that the material can be pumped more easily without clogging the pump intakes.

In one aspect, the apparatus comprises a three-dimensional, box-type frame and a pump housing mounted within the frame. The frame preferably comprises two end plates and a plurality of crossbars connecting the end plates. The frame may optionally comprise a cage attached to the exterior of the frame. When the apparatus is in an upright position, the cage preferably covers the top of the frame and two sides, and the bottom side of the frame remains open. The pump housing has a discharge outlet and opposing inlet openings on opposite sides of the pump housing. The pump housing discharge outlet preferably extends through an opening in the cage. The apparatus further comprises an impeller mounted on a driveshaft within and in spaced relationship with the pump housing. The impeller has outwardly extending blades for movement of flowable material outward to the discharge outlet. The driveshaft is mounted within the frame and extends through the opposing inlet openings of the pump housing. In a preferred embodiment, the driveshaft also extends through openings in each end plate, and each end of the driveshaft is operatively connected to a respective motor. The motors are preferably hydraulic motors each connected to the exterior of a respective end plate and configured for cooperatively rotating the driveshaft.

Utilizing twin hydraulic motors at each end of the driveshaft eliminates the need for shaft bearings, which minimizes external friction and allows the pump of the present invention to run dry indefinitely at maximum speed without causing damage to the pump. Not having shaft bearings also minimizes the potential for low flow cavitation damage from loading and unloading the pump frequently. In addition, the pump has no mechanical seals or wear plates and has no internal friction.

A plurality of agitators are attached to the driveshaft such that the agitators rotate with the driveshaft when the pump is in operation. At least one agitator is positioned on each side of the inlet openings of the pump housing. Each agitator is preferably attached to the driveshaft at an oblique angle. The agitators macerate solid waste, vegetation, and organic matter and agitate the fluid to keep dense particles in suspension. In a preferred embodiment, each agitator comprises a diamond-shaped plate attached to the driveshaft at an oblique angle. The plate may have sharpened edges, depending on the particular application.

To use the pump apparatus to pump flowable material from the bottom of a tank or pond, the twin hydraulic motors are activated and the portable apparatus is lowered to the bottom of the tank or pond. The impeller mounted inside the dual intake pump housing sucks flowable material through the cage and into the inlet openings on both sides of the impeller. The cage is sized to keep large debris from entering the pump housing. The agitators positioned outside of each of the inlet openings macerate solid waste such as vegetation or other organic matter before entering the pump intake openings. The result after maceration is a fine slurry that can be pumped without solid material or debris clogging the pump intakes. A hose is attached to the discharge outlet and routed to a desired discharge location.

Accordingly, one object of the present invention is to provide a pump apparatus that can be used to pump high density, high viscosity fluids or semi-solid material such as sludge from the bottom of a tank, waste pit, or pond.

Another object of the present invention is to provide a pump apparatus having agitators for macerating solids before the material enters the pump intake openings.

Another object of the present invention is to provide a pump apparatus that does not have mechanical seals or wear plates.

Another object of the present invention is to provide a pump apparatus that can run dry for extended periods of time without damage.

Another object of the present invention is to provide an easily portable pump apparatus that can be used to pump highly viscous fluids from the bottom of a tank, waste pit, or pond.

Another object of the present invention is to provide a pump apparatus that can be used to pump highly viscous fluids from a tank or pond in a safe, fast, and cost effective manner.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
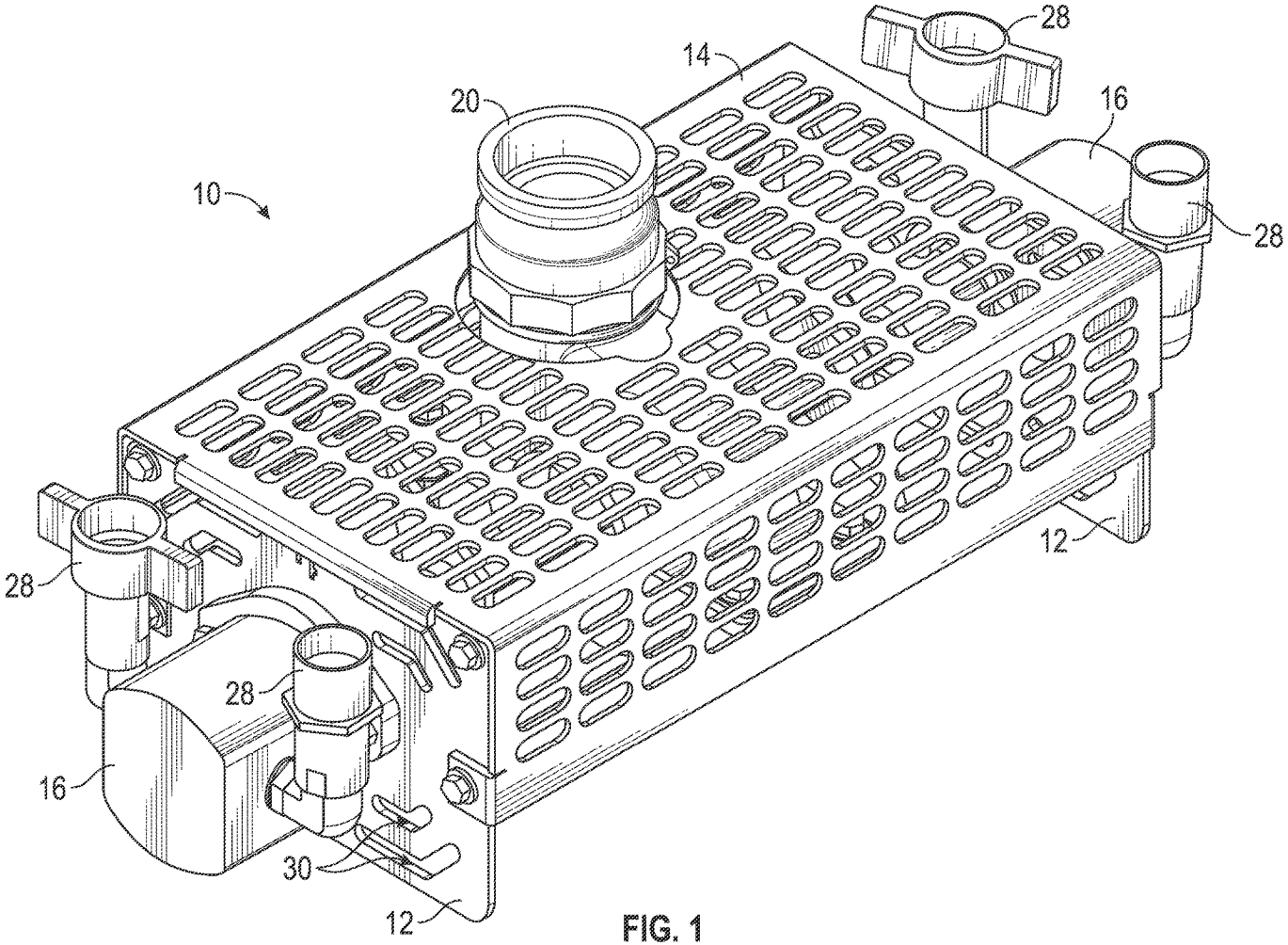
FIG. 1 shows a top perspective view of a pump in accordance with the present invention.
Figure 2:
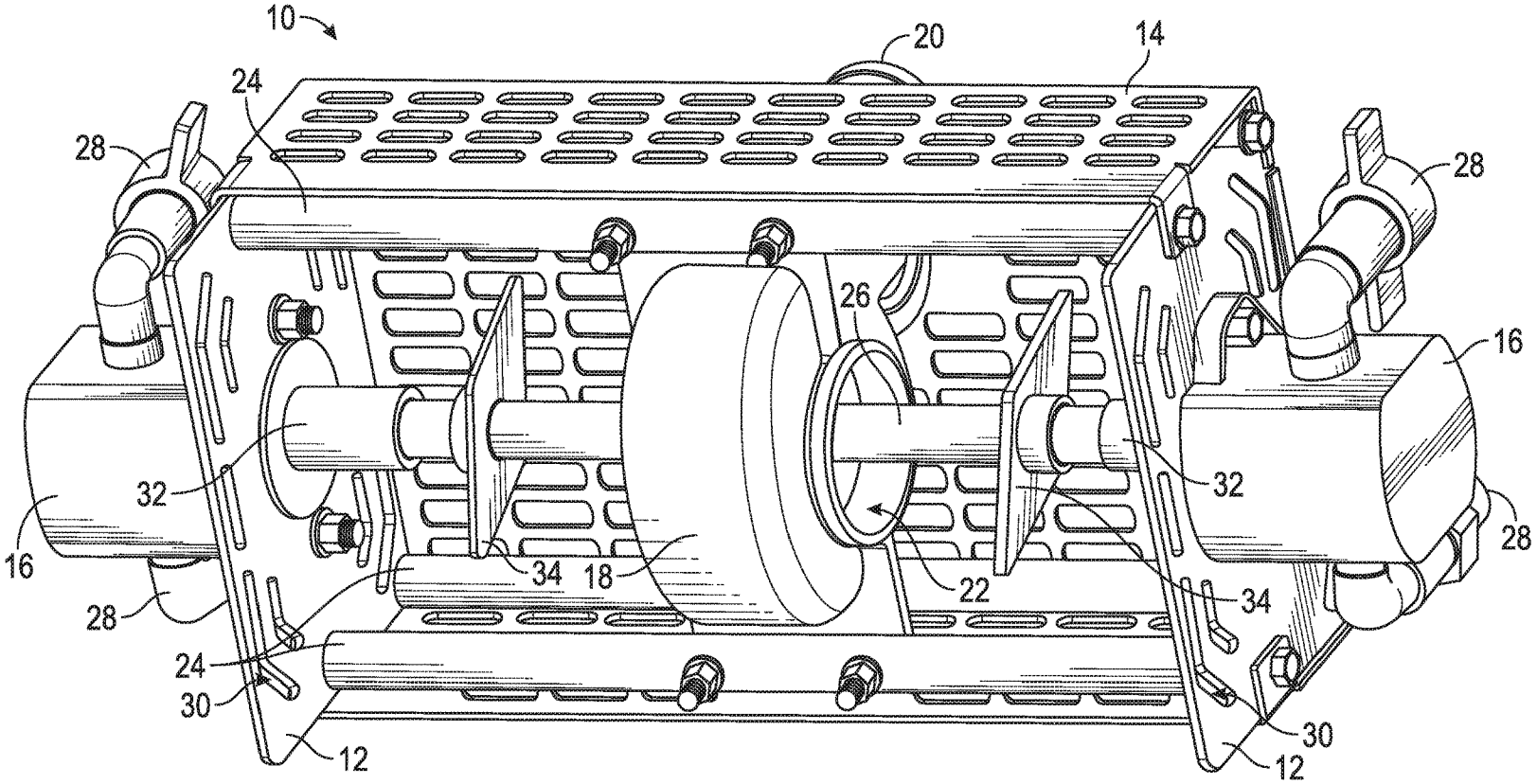
FIG. 2 shows a bottom perspective view of a pump in accordance with the present invention.
Figure 3:
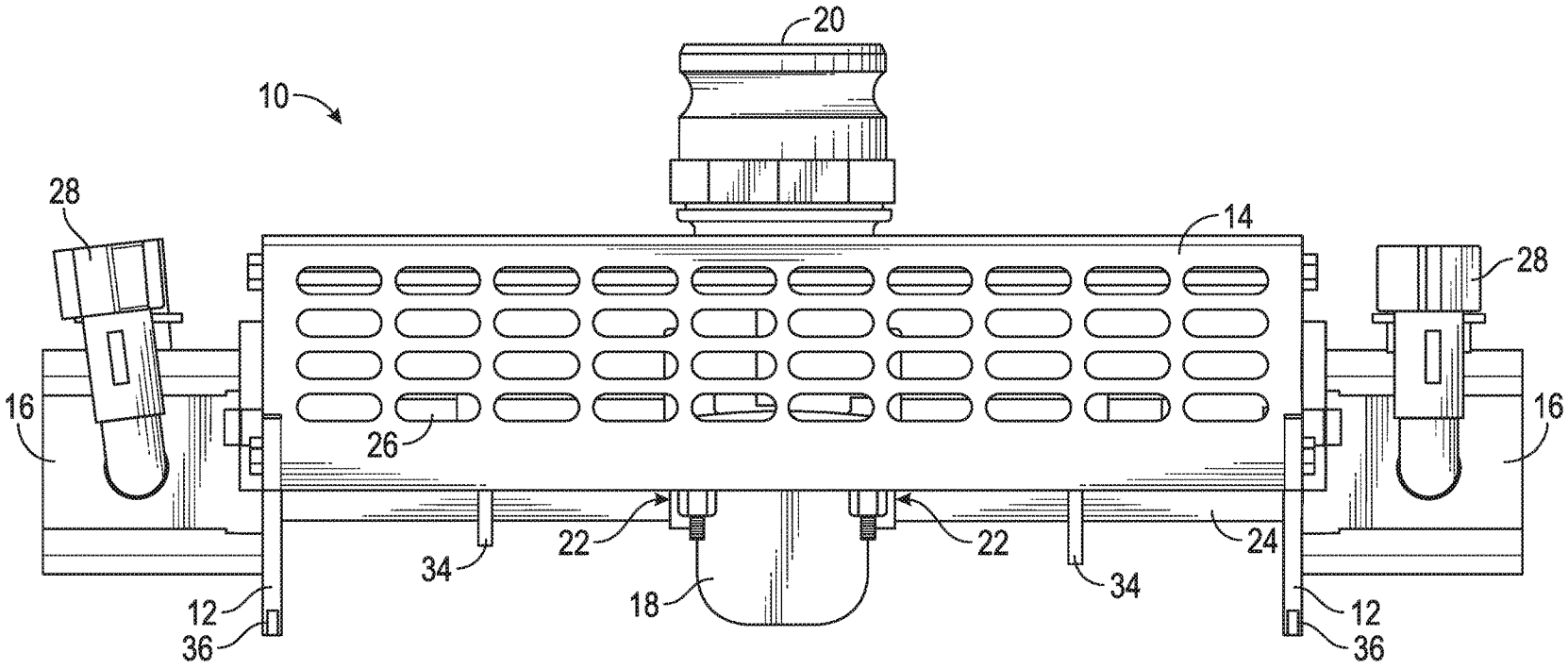
FIG. 3 shows a side elevational view of a pump in accordance with the present invention.

Turning now to the drawings, FIGS. 1-3 show a preferred embodiment of the present invention. In one aspect, a pump apparatus comprises a pump housing 18 disposed within a three-dimensional frame 10. The entire apparatus is designed to be submersible for pumping flowable material from the bottom of a tank, waste pit, or pond. In a preferred embodiment, the frame 10 comprises two end plates 12 and a plurality of crossbars 24 of equal length connecting the end plates 12. As best seen in FIG. 2, each crossbar 24 has two ends, and each end is attached to a respective end plate 12. The frame 10 preferably comprises four crossbars 24 configured to form a three-dimensional, rectangular frame 10. The pump housing 18 is mounted inside the frame 10, preferably by bolting the housing 18 to opposing crossbars 24, as shown in FIG. 2. The pump housing 18 is preferably equidistant from each end plate 12. The end plates 12 and crossbars 24 frame and stabilize the assembly and keep the structure of the pump apparatus rigid so that vibration or cavitation will not damage the pump.

Additionally, the frame 10 preferably comprises a debris cage 14 attached to the exterior of the frame 10. The cage 14 may be secured to the crossbars 24, the end plates 12, or both. When the apparatus is in an upright position, as shown in FIG. 3, the cage 14 preferably covers the top of the frame 10 and two sides and extends between the end plates 12. The bottom side of the frame 10 remains open, as shown in FIG. 2. The cage 14 allows flowable fluids, including solids, to flow through the openings in the cage but blocks larger debris or other solid objects that could potentially damage the pump system mounted inside the frame. In addition, the end plates 12 each have a plurality of suction openings 30 extending through the plates that also allow flowable material to pass through the end plates as fluid is sucked into the pump intakes. The end plates 12, crossbars 24, and cage 14 are preferably made of aluminum or stainless steel.

Figure 4:
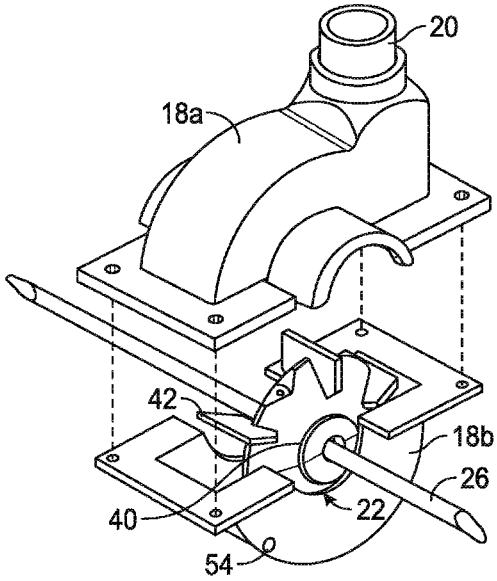
FIG. 4 shows an exploded view of a pump housing in accordance with the present invention.

FIG. 4 shows an exploded view of the pump housing 18 mounted within the frame 10 in accordance with one embodiment of the present invention. Preferably, the pump housing 18 is a split housing comprising an upper housing 18*a* and a lower housing 18*b* that are bolted or otherwise fastened together to form the pump housing 18. The upper housing 18*a* has a discharge outlet 20. As best seen in FIG. 1, the discharge outlet 20 extends outward from the housing 18 and upward through an opening in the cage 14. A hose (not shown) can be connected to the discharge outlet 20 so that flowable material can be discharged through the outlet 20 and transferred to a desired location. The lower housing 18*b* has a drainage port 54 for draining the housing 18 for maintenance.

An impeller 40 is mounted on a driveshaft 26 within the pump housing 18 and in spaced relationship with the pump housing 18 such that neither the impeller 40 nor the driveshaft 26 comes into contact the pump housing 18. In a preferred embodiment, the impeller 40 has a clearance of about 3/16 to about 1/4 inch from the pump housing 18. The assembled pump housing 18 has opposing inlet openings 22 on each side of the housing 18, as shown in FIG. 4. The location of the inlet openings 22 in the complete pump apparatus can also be seen in FIGS. 2 and 3. The annular inlet openings 22 allow flowable material to be sucked into the pump housing 18 through the openings 22 and pumped out of the discharge outlet 20.

Figure 5:
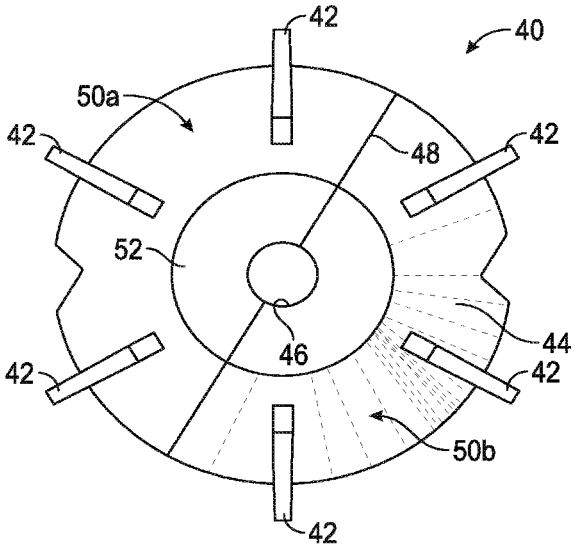
FIG. 5 shows a side elevational view of an impeller in accordance with the present invention.

FIG. 5 shows a preferred embodiment of an impeller 40 utilized with the present invention. The impeller 40 has outwardly extending blades 42 for movement of flowable material outward to the discharge outlet 20. The blades 42 preferably diminish in thickness as they extend outward. The blades 42 are preferably straight but may alternatively be curved. In one embodiment, the impeller 40 is made from two halves, 50*a* and 50*b*, which may be welded together along line 48. In another embodiment, the two-piece impeller 40 may be bolted together for a compression fit to the drive shaft 26. The impeller 40 is provided with an opening or channel 46, which may be keyed for use with the driveshaft 26. Both sides of the impeller 40 have a sloped surface 44 and a flat portion 52, which is formed as a result of grinding or shearing so as to balance the impeller. The blades 42 are attached to the sloped surface 44. Preferably, the sloped surface 44 of the impeller 40 has a slope of about 30 to about 45 degrees. The sloped surfaces 44 on each side of the impeller 40 moves flowable material outward toward the blades 42 for discharge through the discharge outlet 20.

The driveshaft 26 is mounted within the frame 10, and at least one end of the driveshaft 26 is connected to a motor 16 configured for rotating the driveshaft 26. In a preferred embodiment, the apparatus utilizes dual hydraulic motors 16. The motors 16 are attached to the exterior of each end plate 12, respectively. As best seen in FIGS. 2 and 4, the driveshaft 26 extends through both of the opposing inlet openings 22 of the pump housing 18 in a spaced, non-contacting relationship to the pump housing 18. The driveshaft 26 further extends through an opening in each end plate 12 so that each end of the driveshaft 26 can be connected to a respective hydraulic motor 16 via a coupling 32. Hoses for hydraulic fluid (not shown) can be attached to fluid connection ports 28 for driving the hydraulic motors 16. The two hydraulic motors 16 are configured for cooperatively rotating the driveshaft 26. The use of dual hydraulic motors 28 eliminates the need for shaft bearings to support the driveshaft 26, which is particularly advantageous when pumping abrasive solids because abrasive solids may cause damage to bearings. The elimination of shaft bearings also minimizes external friction and allows the pump to run dry indefinitely at maximum speed without causing damage to the pump. Not having shaft bearings also minimizes the potential for low flow cavitation damage from loading and unloading the pump frequently. In addition, the pump has no mechanical seals or wear plates and has no internal friction.

In alternative embodiments, the apparatus may utilize an electric motor or a direct drive shaft from an engine for providing rotation to the driveshaft. The driveshaft has either spline shaft connections or keyed couplings, depending on the type of drive motor utilized with the apparatus. For electric motors, a coupling or a male spline shaft can be inserted into a female spline that is built into the electric motor, which may eliminate the need for a coupling. For hydraulic drive motors, a keyed coupling 32 is installed between the hydraulic motor 16 and the driveshaft 26. The hydraulic motors may be powered by a hydraulic power unit (HPU).

As best seen in FIG. 2, the apparatus further comprises a plurality of mechanical agitators 34 attached to the driveshaft 26. At least one agitator 34 is positioned on each side of the inlet openings 22 of the pump housing 18. In a preferred embodiment, one agitator 34 is utilized on each side for a total of two, though additional agitators 34 may be used on each side of the inlet openings 22, depending on the application. In a preferred embodiment, each agitator 34 comprises a diamond-shape plate. In another preferred embodiment, as shown in FIG. 2, each agitator 34 is attached to the driveshaft 26 at an oblique angle. The agitators 34 are preferably made of high-strength steel and can be spin balanced and mounted on the driveshaft 26. The driveshaft 26 has keyways to hold the agitators 34 in place. The agitators macerate solid waste, vegetation, and organic matter and agitate the fluid to keep dense particles in suspension. The agitators also help to feed solids into the inlet openings 22. The result after maceration is a fine slurry having suspended solid material of reduced size that can be pumped without clogging the pump intakes.

In one embodiment, the agitators 34 may have sharpened edges. This embodiment may be preferred in applications in which it is desirable to cut solid materials into smaller pieces, such as large pieces of vegetation or other pieces of vegetation that could damage the pump, such as plant roots. However, blunt edges are the preferred embodiment in applications in which it is desirable to keep abrasive solids suspended in a slurry.

To use the pump apparatus to pump flowable material from the bottom of a tank, waste pit, or pond, hydraulic fluid lines are attached to the fluid connection ports 28 on each of the twin hydraulic motors 16. The motors 16 are activated, and the portable apparatus is lowered to the bottom of the tank, pit, or pond. The impeller 40 mounted inside the dual intake pump housing 18 sucks flowable material through the cage 14 and into the annular inlet openings 22 on both sides of the impeller 40. As shown in FIG. 3, which shows the apparatus in an upright position, the cage 14 preferably does not extend all the way down each side of the frame 10 so that the bottoms 36 of the end plates 12 act as feet that support the apparatus above the bottom surface of the tank or pond. This allows some sludge or other organic matter resting on the bottom of the tank or pond to be sucked under the cage 14 while the cage still keeps large debris from entering the pump housing 18. The agitators 34 positioned outside of each of the inlet openings 22 macerate solid waste such as vegetation or other organic matter before entering the pump intake openings 22. The agitators 34 also help to feed solids into the double suction pump in high concentration. The fluid entering the intakes is a fine slurry having suspended solids of reduced size. The slurry can be pumped without solid material or debris clogging the pump intakes 22. A hose is attached to the discharge outlet 20 and routed to a desired discharge location. A chain or rope can be attached to the apparatus to remove it from the tank, pit, or pond after pumping.

The pump apparatus of the present invention is versatile and can be used in a variety of different applications, such as dredging, tank cleaning, pumping abrasive solids from pits, pumping oilfield drilling cement or oilfield waste such as drill cuttings, pumping oilfield fracturing sand, and pumping a mud slurry or a slurry containing vegetation or other organic waste. The agitators are particularly advantageous in increasing the amount of solids, such as sand or drill cuttings, pumped by the apparatus. For instance, sand was pumped from the bottom of a pond first without agitators 34 and then with agitators. Without agitators, the sand concentration in the pumped slurry was about 15%. Utilizing twin agitators on either side of the pump housing 18 increased the sand concentration in the pumped slurry to about 60-80%.

The pump apparatus of the present invention provides a number of advantages over other pump designs. The double-suction impeller 40 design of the pump apparatus functions as a strong fan that can pull a vacuum, self-prime, and begin pumping. The double-sided impeller 40 does not have tight tolerances, which allows passage of abrasive solids with a minimal amount of erosional wear. The pump can run wet or dry and pump in forward or reverse without damaging the pump. The double-suction impeller 40 design eliminates thrust loading of the impeller by eliminating the differential pressure across the impeller. The pressure is equal on both sides of the impeller because the impeller is pulling flow from both sides. The equalized pressure eliminates the need for mechanical seals and wear plates, and consequently this centrifugal pump has no internal friction. The dual hydraulic motors provide high flow rates and high vertical head pressure. The dual hydraulic motors also eliminate the need for shaft bearings and allow the pump to run dry continuously without damaging the pump. The double suction pump produces variable speed and flow and greater efficiency and reliability for severe service applications requiring pumping, mixing, and macerating of non-miscible fluids.

It is understood that versions of the invention may come in different forms and embodiments. Additionally, it is understood that one of skill in the art would appreciate these various forms and embodiments as falling within the scope of the invention as disclosed herein.

What is claimed is:

1. A submersible pump apparatus, comprising:

a. a three-dimensional frame;

b. a pump housing having a discharge outlet and opposing inlet openings on opposite sides of the pump housing, wherein the pump housing is mounted within the frame;

c. an impeller mounted on a driveshaft and within the pump housing, wherein the impeller has outwardly extending blades for movement of a flowable material toward the discharge outlet, wherein the driveshaft is mounted within the frame and extends through the opposing inlet openings of the pump housing, and wherein the driveshaft is connected to a motor configured for rotating the driveshaft; and d. an agitator attached to the driveshaft and configured to macerate the flowable material, wherein the agitator is positioned outside an exterior surface of the pump housing and is spaced from and exterior to an entrance to at least one of the inlet openings.

2. The apparatus of claim 1, wherein the apparatus comprises two motors, wherein each end of the driveshaft is connected to a respective motor, and wherein the two motors are configured for cooperatively rotating the driveshaft.

3. The apparatus of claim 2, wherein the apparatus is free of internal bearings, mechanical seals, and wear plates.

4. The apparatus of claim 1, wherein the three-dimensional frame comprises two end plates and a plurality of crossbars, wherein each crossbar has two ends, and wherein each end is attached to a respective end plate.

5. The apparatus of claim 4, wherein the apparatus comprises two motors, wherein each end of the driveshaft is connected to a respective motor, and wherein the two motors are configured for cooperatively rotating the driveshaft.

6. The apparatus of claim 5, wherein the driveshaft extends through an opening in each end plate and each motor is attached to an exterior surface of a respective end plate.

7. The apparatus of claim 4, wherein each end plate has a plurality of suction openings therethrough.

8. The apparatus of claim 4, further comprising a cage secured to an exterior surface of the frame.

9. The apparatus of claim 8, wherein the cage covers a top of the frame and at least two sides of the frame.

10. The apparatus of claim 8, wherein the pump housing discharge outlet extends through an opening in the cage.

11. The apparatus of claim 1, wherein the motor is a hydraulic motor.

12. The apparatus of claim 1, wherein the agitator comprises a diamond-shaped plate.

13. The apparatus of claim 12, wherein the agitator is attached to the driveshaft at an oblique angle.

14. The apparatus of claim 1, wherein the impeller has a slope on both sides of about 30 to about 45 degrees.

15. The apparatus of claim 1, wherein there is approximately equal pressure on both sides of the impeller.

16. The apparatus of claim 1, wherein the pump housing is a split housing.

17. The apparatus of claim 1, wherein the pump apparatus is self-priming.

18. The apparatus of claim 1, wherein the driveshaft extends through the opposing inlet openings in a spaced, non-contacting relationship to the pump housing.

19. The apparatus of claim 1, wherein the impeller comprises two halves that are bolted together such that the two halves are compressed against the driveshaft.

20. The apparatus of claim 1, wherein the apparatus is free of internal bearings, mechanical seals, and wear plates.

21. A submersible pump apparatus, comprising:

a. a three-dimensional frame;

b. a pump housing having a discharge outlet and opposing inlet openings on opposite sides of the pump housing, wherein the pump housing is mounted within the frame;

c. an impeller mounted on a driveshaft and within the pump housing, wherein the impeller has outwardly extending blades for movement of a flowable material toward the discharge outlet, wherein the driveshaft is mounted within the frame and extends through the opposing inlet openings of the pump housing;

d. two hydraulic motors, wherein each end of the driveshaft is connected to a respective motor, and wherein the motors are configured for cooperatively rotating the driveshaft; and e. an agitator attached to the driveshaft and configured to macerate the flowable material, wherein the agitator is positioned outside an exterior surface of the pump housing and is spaced from and exterior to an entrance to at least one of the inlet openings.

22. The apparatus of claim 21, wherein the agitator comprises a diamond-shaped plate.

23. The apparatus of claim 22, wherein the agitator is attached to the driveshaft at an oblique angle.

24. The apparatus of claim 21, wherein the apparatus is free of internal bearings, mechanical seals, and wear plates.

* * * * *